US006375755B1

(12) United States Patent
Stuck

(10) Patent No.: US 6,375,755 B1
(45) Date of Patent: Apr. 23, 2002

(54) METHOD OF CLEANING A MOVIE SCREEN

(76) Inventor: David Stuck, 610 Parkview La., Richardson, TX (US) 75080

( * ) Notice: Subject to any disclaimer, the term of this patent is extended or adjusted under 35 U.S.C. 154(b) by 0 days.

(21) Appl. No.: 09/493,055

(22) Filed: Jan. 26, 2000

(51) Int. Cl.[7] ..... B08B 3/04; B08B 3/08
(52) U.S. Cl. ..... 134/6; 134/26; 134/27; 134/38
(58) Field of Search ..... 134/6, 26, 27, 134/38

(56) References Cited

U.S. PATENT DOCUMENTS 4,717,426 A * 1/1988 Brynildsen ..... 134/26
4,952,248 A * 8/1990 Aberg ..... 134/40
6,191,759 B1 * 2/2001 Kintz ..... 345/8

* cited by examiner

*Primary Examiner*—Zeinab El-Arini
(74) *Attorney, Agent, or Firm*—Steven W. Thrasher

(57) ABSTRACT

The present invention provides advantages as a method of cleaning movie screens, such as vinyl screens, enhanced screens, painted screens, taurus screens, rear projection screens, and silver screens. In one embodiment, the present invention is a method of cleaning a movie screen by applying a cleaning chemical to the movie screen, wiping the movie screen with a first towel, applying a neutralizer to the movie screen, wiping the movie screen with a second towel, and drying the movie screen.

20 Claims, 2 Drawing Sheets

METHOD OF CLEANING A MOVIE SCREEN

FIELD OF THE INVENTION

The present invention relates generally to cleaning a surface, and more specifically to approaches and methods of cleaning movie screens (also called cinema screens or theater screens).

BACKGROUND OF THE INVENTION

Movie theater establishments invest large amounts of money to purchase movie screens (also known as cinema screens or theater screens). A plain vinyl screen, also known as a matte white screen, typically costs several thousand dollars. A fluorescent, silver glow, or some other type of high-gain type of screen may cost in the range of tens of thousands of dollars, while a silver screen may cost a hundred thousand dollars or more. Accordingly, it is important to movie theater establishments to protect their investments in the movie screens they install in their theaters.

Unfortunately, a movie screen (the screen) is subject to regular abuses. For example, patrons regularly throw food—such as sodas, Gummy Bears and other candies—and objects such as spitballs at the screen. In addition, environmental considerations can affect movie screen quality. For example, in dusty climates, such as the dessert southwest, exposure to dust may deteriorate a movie screen's reflective quality. Furthermore, extremely dry or extremely damp, humid climates can compound problems associated with regular dust and dirt buildup. In dry climates, dust may be statically attracted to the screen. In damp climates, condensation may form on the screen and dust may then adhere to the screen via the condensation.

Movie screen quality is measured in the movie industry by gauging the reflective ability of the screen. The unit of measurement of this reflective ability is known as a Foot Lambert, and the higher the Foot Lambert number, the more reflective the screen. Over time, as discussed above, the build up of dust and debris reduces the reflective ability of the screen. Accordingly, poor reflectivity of a movie screen leads to poor movie quality.

Poor movie quality manifests itself in the form of lower picture sharpness, less vibrant colors, and less noticeable color gradient. Thus, special effects have a lower impact and some camera work may even be hidden, resulting in lower viewer satisfaction.

Prior art movie screen cleaning processes have been known to ruin movie screens. For example, high-pressure sprayers or window cleaning equipment may damage the screen. In addition, "spot cleaning" and letting the screen air dry can result in screens that are not any more reflective. Accordingly, current movie industry practice is to not clean movie screens, even though this results in poor screen quality. Therefore, there exists a need a method of cleaning dirty movie screens to increase the Foot Lambert reflectivity of the movie screen.

SUMMARY OF THE INVENTION

The present invention provides advantages as a method of cleaning movie screens, such as vinyl screens, enhanced screens, painted screens, taurus screens, rear projection screens, and silver screens. Generally, the method begins with an evaluation of a movie screen, and then proceeds with a cleaning process based on the results of the evaluation. The method may employ dusting as well as the application of cleaning chemicals, and may be repeated until satisfactory results are obtained. Accordingly, the present invention teaches movie screen cleaning that effectively removes sugar based buildup, dirt and dust thus increasing the Foot Lambert reflectivity of the movie screen and enhancing the viewing experience for movie patrons.

In one embodiment, the present invention is a method of cleaning a movie screen. The comprises the sequential steps of applying a cleaning chemical to the movie screen, wiping the movie screen with a first towel, applying a neutralizer to the movie screen, wiping the movie screen with a second towel, and drying the movie screen. The cleaning chemical, is applied using a low-pressure spray.

The towels that are used to clean the screen should be at least clean, and preferably are chemical free white towels. When using the towels, they should be traversed across the screen in vertical, overlapping rows.

The neutralizer preferred is water. However, if there is a concern about mineral deposits leaving stains, filtered or distilled water can be used. Drying a damp screen may be accomplished with a blower to prevent water marks.

Additional steps may enhance the cleaning process. For example, dusting the screen before applying the cleaning chemical may facilitate screen cleaning. In addition, spot-treating the screen to remove sugar based substances before applying the cleaning chemical may also aid in screen cleaning. Furthermore, cleaning the screen in sections, such that a first section of the movie screen is cleaned and then a second section of the movie screen is cleaned, where the first section partially overlapping the second section, can provide good results.

Especially dirty screens may need additional attention. Occasionally, reapplying the cleaning chemical before applying the neutralizer may be necessary. Furthermore, reapplying the neutralizer before drying the screen may be necessary to completely remove the cleaning chemical.

BRIEF DESCRIPTION OF THE DRAWINGS

Other aspects of the invention, including specific embodiments, can be understood by reference to the following Detailed Description of a Preferred Embodiment, which should be viewed in conjunction with the drawings, in which.

DESCRIPTION OF THE PREFERRED EMBODIMENT

The present invention teaches a method of cleaning a movie screen that effectively removes sugar-based buildup, dirt, dust and other debris that collect on a movie screen over time. The method of cleaning a screen increases the Foot Lambert reflectivity of the movie screen, which enhances the viewing experience for movie patrons. Generally, the method begins with an evaluation of a movie screen, and then proceeds with a cleaning process based on the results of the evaluation. The method may employ the steps of dusting the screen, applying cleaning chemicals to the screen, rubbing the screen with a clean cloth, and neutralizing the cleaning chemical. The screen is also dried in a controlled manner. The method of cleaning a movie screen may be repeated until satisfactory results are obtained.

Chemical Preparation

Figure 1:
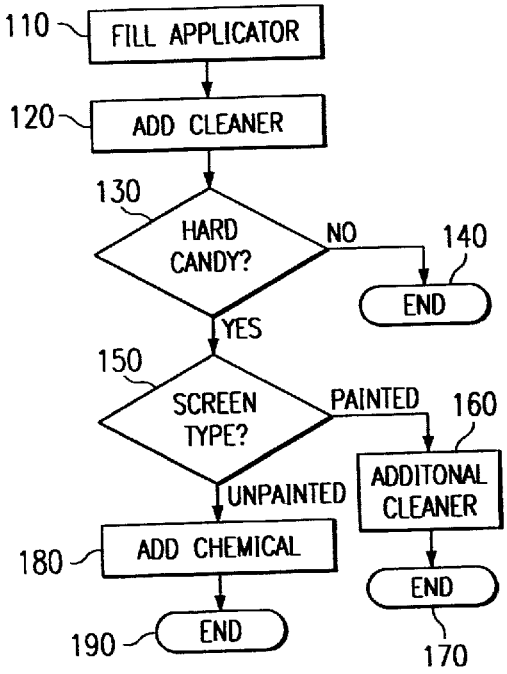
FIG. 1 is a flow diagram illustrating the steps used to prepare a cleaning chemical for use in the method of cleaning a movie screen.

Although chemicals may not be required to clean every screen, it is helpful to discuss the method of preparation of cleaning chemicals prior to a discussion of the method of cleaning a movie screen. FIG. 1 is a flow diagram illustrating the process used to prepare a cleaning chemical for use in the method of cleaning a movie screen. First, in a fill applicator step 110, a pressurized spray bottle, such as a one and a half gallon chemical spray bottle (these are commonly associated with applying chemicals to plants, or to spray for insects in the home) is filled with a solvent. Typically, the solvent will be water. Purified water, such as that obtained trough filtration or distillation, is preferred. However, for unpainted screens, as discussed later, the solvent may be any heavy duty cleaner/degreaser that is free rinsing, and preferably, biodegradable. Note that the pressure in the spray bottle should never be raised to a point where the spray from the bottle could harm the screen.

Next, in an add cleaner step 120, a cleaning solute is added to the solvent. The cleaning solute can be any cleaning chemical made for removing dirt, candy and other debris from a surface. In general, the solute is of a neutral pH, is free rinsing, leaves no soap film, and works in hard water. Preferably, the solute is also biodegradable. In the preferred embodiment, Sodium EDTA, Cocodiethanolamide, Ethylene Glycol Butyl Ether, Sodium Tripolyphosphate, Sodium Meta Silicate, Sodium Xylene Sulfanate, is used as the solute, and is added such that the concentration of the solute in solution is two ounces of the first solute each half-gallon of solvent (water) to create what is referred to as the mild solution.

Next, in a detect hard candy query 130, the movie screen is evaluated to detect sugar-based (typically hard) candy, such as gummy bears, gummy worms, or other sugar-based substances—especially those that have the ability to penetrate the movie screen. If no such substances are found, then the movie screen may be cleaned with the mild solution. Accordingly, the method of mixing the cleaning chemical proceeds to an end step 140 and the method of cleaning a movie screen may begin with the mild solution. However, if sugar-based substances are detected in the detect hard candy query 130, then the method proceeds to a screen type query 150.

In the screen type query 150, the cleaner of the screen determines the movie screen type. The movie screen will be typically either be a painted screen (including a silver screen) or a non-painted screen such as a vinyl screen or an enhanced screen. Occasionally one may encounter a rubberized screen or a cloth screen, and these should be cleaned as if they were painted screens. If the screen is a painted screen, then the method proceeds to an add additional cleaner step 160 and an additional two ounces of solute are added to the cleaning chemical for each one-half gallon of solvent. Then, this cleaning chemical mixture may be used to clean the painted screen, as is indicated by an end step 170.

However, if the screen is not a painted screen, proceeds to an add chemical step 180 in which a new additional cleaning agent is added to the cleaning chemical. The new additional cleaning agent is selected for its ability to dissolve sugar-based substances, and should be a recognized solvent. In the preferred embodiment, a cleaning agent, generally comprising Sodium, EDTA, Ammonium Lauryl Sulfate and Sodium Tripolyphosphate is the preferred additional cleaning agent and is added to the cleaning chemical in the concentration of approximately two ounces off the cleaning agent to each one half gallon of water. In no case should the cleaning agent be applied to a painted screen. After adding the cleaning agent in the add chemical step 180, the method of mixing the cleaning chemical ends and the movie screen may be cleaned, as indicated by an end step 190.

Sometimes the method discussed above may need to be modified based on the dirtiness the screen. For example, should the screen be unusually dirty, the concentration of the solute in the cleaning chemical may be increased in discrete magnitudes (four, six, or eight ounces of the solute to each one half gallon of solvent, for example). In addition, for non-painted screens only, the concentration of the cleaning agent in the cleaning chemical may be increased in discrete magnitudes as well.

The concentrations chosen are based on the experience of the person doing the cleaning. However, for those with less experience, or to decrease the probability of damaging a screen, it is often preferable to try a lower concentration of the solute and/or the cleaning agent, and then, after attempting to clean the movie screen, to increase the concentration of solute one discrete level of concentration (in the preferred embodiment, two additional ounces of the solute for a painted screen, or two additional ounces of the cleaning agent for an unpainted screen, per one-half gallon of water), and then re-attempt to clean the screen before increasing the concentration further. Whenever a screen is cleaned with a cleaning chemical other than the "mild" concentration, as a last cleaning step the screen should be cleaned with the mild concentration before rinsing. This removes any excess concentrated cleaning chemical.

Cleaning the Movie Screen

Figure 2:
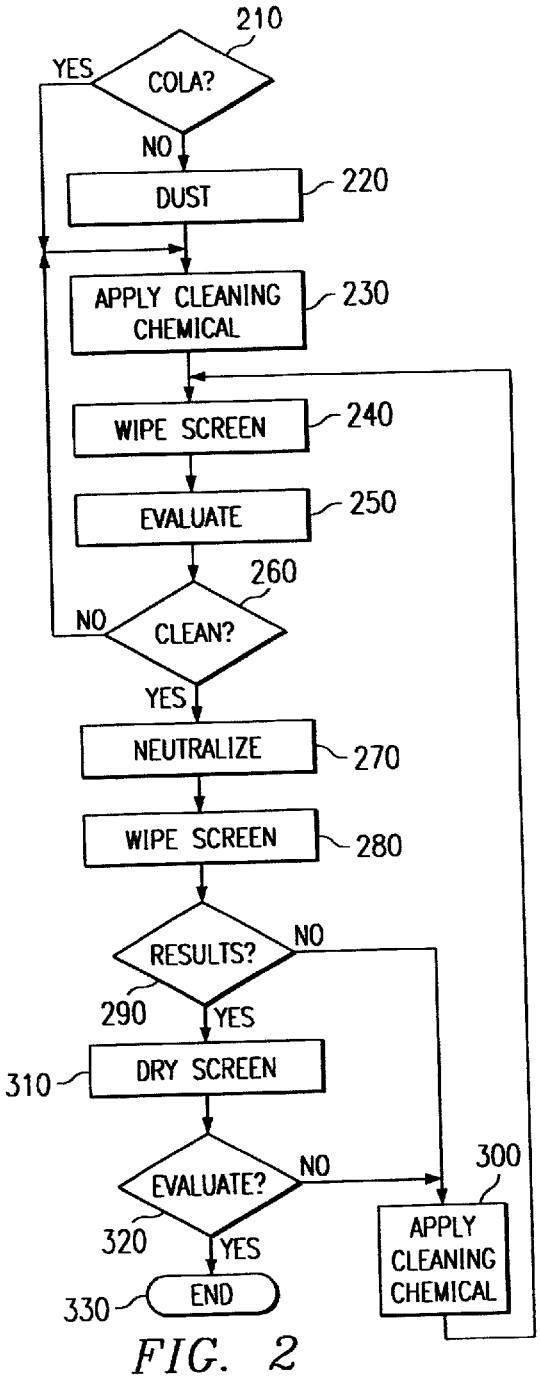
FIG. 2 is a flow diagram showing the method of cleaning a movie screen according to the present invention.

After preparing the cleaning chemical one may proceed to clean the movie screen. FIG. 2 is a flow diagram showing the method of cleaning a movie screen according to the present invention. First, in a detect cola query 210, the movie screen is checked for sticky or sugary residue. If a minimal amount of sticky or sugary residue is found (this is a judgment call based on experience, however, there should not be enough sticky residue on the screen to collect dust or otherwise interfere with the wiping of the screen), the method proceeds to a dust step 220. In the dust step 220 the movie screen is wiped with a clean cloth. Of course, other types of dusting equipment may be used to remove loose dirt, dust, and debris from the movie screen, before proceeding to an apply cleaning chemical step 230. In any step where the cleaning chemical is applied, as discussed in the method of mixing the cleaning chemical above, the cleaning chemical may be remixed to increase the concentration of solute. In addition, one may use a screen brush which is specially designed for the dusting of movie screens. In general, when dusting, one should dust with up and down motions in slightly overlapping rows.

If in the cola query 210 sticky residue is discovered on the movie screen, then the method proceeds to an apply cleaning chemical step 230. In the apply cleaning chemical step 230 the cleaning chemical prepared according to the method disclosed above is sprayed onto the movie screen using a low pressure sprayer. The spray should not be so strong as to by itself remove food particles or caked-dust from the screen, and should not "push" the cleaning chemical through the movie screen. After the cleaning chemical is applied to the movie screen the method proceeds to a wipe screen step 240.

Figure 2A:
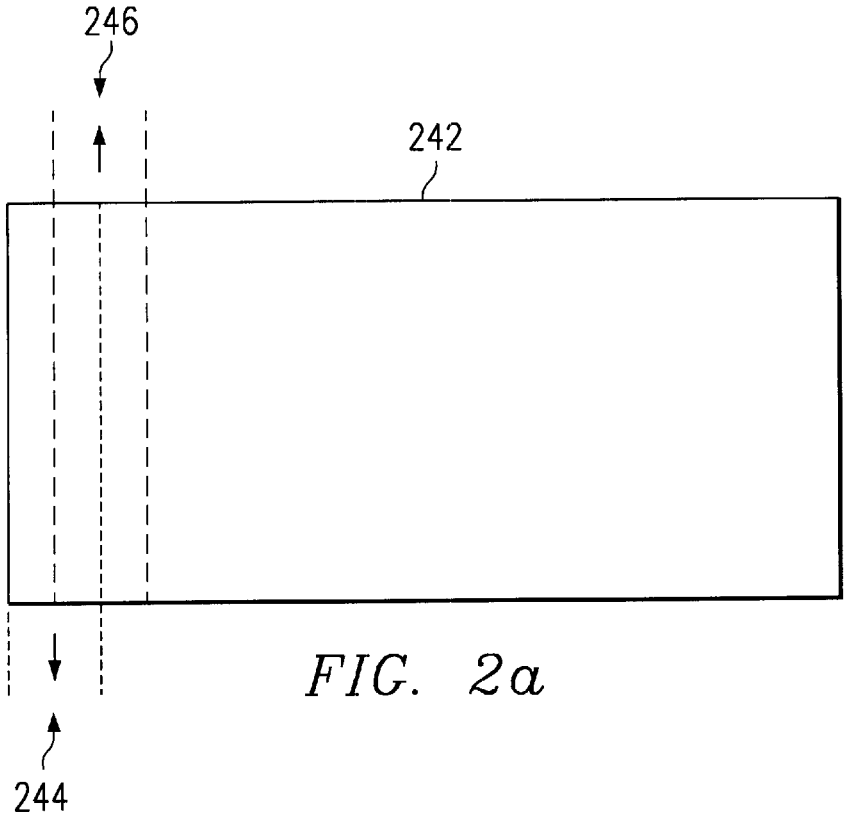
FIG. 2*a* illustrates a preferred approach to wiping the movie screen.

In the wipe screen step 240 a chemical free white towel (the towel) is wiped across the movie screen in a predefined pattern. FIG. 2*a* illustrates a preferred approach to wiping the movie screen. The towel should be moved across the movie screen 242 in vertical, overlapping strokes. In FIG. 2*a* a first downward vertical stroke is indicated by a first arrow 244, and has a width indicated by the dotted lines. A second upward vertical stroke is indicated by a second arrow 246 and has a width indicated by the dashed lines. Note that the upward vertical stroke partially overlaps the downward vertical stroke. The overlapping of the strokes insures that the entire movie screen area is traversed by the towel. The use of a clean towel throughout the process should be stressed so that the user understands that each stroke of a row should begin with a substantially clean towel, or a substantially clean portion of a towel. Of course, other types of cloths and equipment may be used to wipe the screen.

Figure 2B:
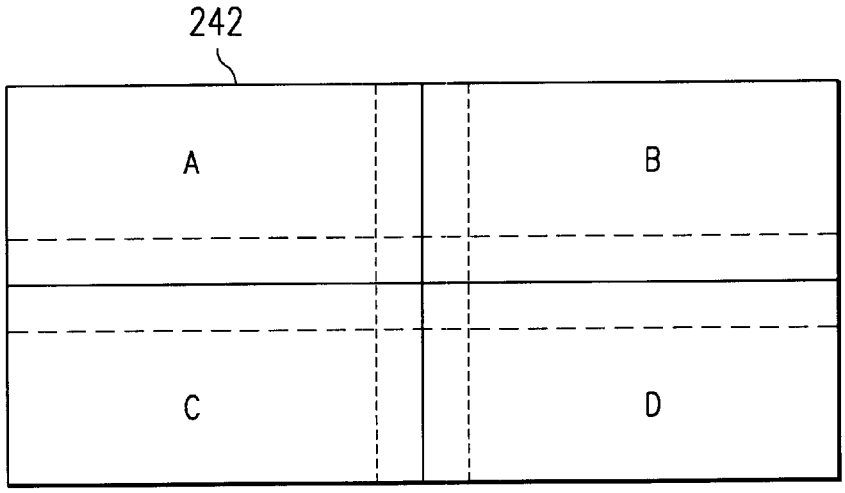
FIG. 2*b* illustrates the movie screen divided into four quadrants.

In the event that a movie screen must be cleaned in sections, the cleaning of each section should overlap as well, as indicated in FIG. 2*b*. In FIG. 2*b* the movie screen 242 is shown divided into four quadrants A, B, C, and D. It is preferred that the top of the screen be cleaned before the bottom of the screen. Accordingly, sections A and B are cleaned before sections C and D. When cleaning a section, a cleaner (the person cleaning the screen) should clean an area larger then that section. Accordingly, in FIG. 2*b*, the actual area of the movie screen cleaned is indicated by the dashed lines lying just outside the section. Thus, the area between the dotted lines indicates areas of the movie screen that experience overlapping cleaning.

After the screen is wiped, the screen is evaluated in an evaluate step 250 and the cleaner notes the condition of the screen by recording the dirtiness of the screen as well as the dampness of the screen. Then, in a clean query 260, if it is determined that the screen is not satisfactorily responding to the cleaning chemical and wiping, the method of cleaning a screen returns to the apply cleaning chemical step 230. If, however, in the clean query 260, the screen appears to be responding, then the method of cleaning a screen proceeds to a neutralize step 270. In the neutralize step 270 a chemical that neutralizes (the neutralizer) the cleaning chemical is applied to the movie screen using a second low-pressure sprayer. The neutralizer used to remove the cleaning chemicals discussed above is water. Preferably purified water, such as distilled water or filtered water is used as these have had their minerals removed.

After neutralizing the cleaning chemical, the method proceeds to a second wipe screen step 280. The second wipe screen step should be executed in a manner similar to the first wipe screen step 240 (additional clean, chemical free white towels should be used for this step). After the second wipe screen step 280 the method proceeds to a results query 290. In the result query 290 the screen is checked to determine if it is satisfactorily cleaned and free of streaks and other stray marks. If the screen is not satisfactorily cleaned, then additional cleaning chemical is applied to the screen and the method returns to the wipe screen step 240. If the cleaning results are satisfactory, the method proceeds to a dry screen step 310.

To dry the screen additional dry, clean, chemical free white towels are wiped across the screen in a manner similar to that disclosed in the first wipe screen step 240. In addition, other methods of drying the screen are optional. For example, a blower, such as a leaf blower, may be used to dry especially wet screens. When using a blower to dry a screen, the user of the method should make sure that the screen is damp (not wet) prior to using the blower. This can be accomplished by using towels to partially dry the screen. Furthermore, theater temperature settings and environmental controls should be set to facilitate drying.

After the dry screen step 310 the method proceeds to an evaluate query 320. In the evaluate query 320 the screen is checked to determine if it is satisfactorily cleaned and free of streaks and other stray marks. If the screen is not satisfactorily cleaned, then additional cleaning chemical is applied to the screen in an applied cleaning chemical step 300 and the method returns to the wipe screen step 240. If the cleaning results are satisfactory, the method concludes with an end step 330.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

What is claimed is:

1. A method of cleaning a movie screen, comprising the sequential steps of:

applying a cleaning chemical to the movie screen;

wiping the movie screen with a first towel;

applying a neutralizer to the movie screen;

wiping the movie screen with a second towel; and drying the movie screen.

2. The method of cleaning of a movie screen of claim 1 wherein the cleaning chemical is applied using a low-pressure spray.

3. The method of cleaning a movie screen of claim 1 wherein the cleaning chemical is a solution comprising: Sodium EDTA, Ammonium Lauryl Sulfate and Sodium Tripolyphosphate.

4. The method of cleaning a movie screen of claim 1 wherein the cleaning chemical is a solution comprising two ounces of a solute comprising: Sodium EDTA, Ammonium Lauryl Sulfate and Sodium Tripolyphosphate added to a half gallon of water.

5. The method of cleaning a movie screen of claim 1 wherein the first towel is a chemical free white towel.

6. The method of cleaning a movie screen of claim 1 wherein first towel is traversed across the screen in vertical, overlapping rows.

7. The method of cleaning a movie screen of claim 1 wherein the neutralizer is water.

8. The method of cleaning a movie screen of claim 1 wherein the neutralizer is filter water.

9. The method of cleaning a movie screen of claim 1 wherein the second towel is traversed across the screen in vertical, overlapping rows.

10. The method of cleaning a movie screen of claim 1 wherein the step of drying is accomplished with at least a third towel.

11. The method of cleaning a movie screen of claim 1 wherein the step of drying is accomplished with a blower.

12. The method of cleaning a movie screen of claim 1 further comprising the step of dusting the screen before applying the cleaning chemical.

13. The method of cleaning a movie screen of claim 1 further comprising the step of spot-treating the screen to remove sugar based substances before applying the cleaning chemical.

14. The method of cleaning a movie screen of claim 1 further comprising the step of reapplying the cleaning chemical before applying the neutralizer.

15. The method of cleaning a movie screen of claim 1 further comprising the step of reapplying the neutralizer before drying the screen.

16. The method of cleaning a movie screen of claim 1 wherein the method separately cleans a first section of the movie screen and then cleans a second section of the movie screen, wherein the first section partially overlaps the second section.

17. A method of cleaning a vinyl surface, comprising the steps of:

applying a cleaning chemical to the vinyl surface, the cleaning chemical comprising two ounces of a solute per a half gallon of water, the solute comprising: Sodium EDTA, Ammonium Lauryl Sulfate and Sodium Tripolyphosphate, and the cleaning chemical also comprising about two ounces of a cleaning agent comprising: Sodium EDTA, Cocodiethanolamide, Ethylene Glycol Butyl Ether, Sodium Meta Silicate, Sodium Xylene Sulfanate added to a half gallon of water;

wiping the vinyl surface with a first towel;

applying a neutralizer to the vinyl surface;

wiping the vinyl surface with a second towel; and drying the vinyl surface.

18. The method of cleaning a vinyl surface of claim 17 wherein the cleaning agent comprises Sodium EDTA, Cocodiethanolamide, Ethylene Glycol Butyl Ether, Sodium Tripolyphosphate, Sodium Meta Silicate, Sodium Xylene Sulfanate.

19. A method of cleaning a painted surface, comprising of the steps of:

applying a cleaning chemical to the painted surface;

wiping the painted surface with a first chemical free white towel;

applying a neutralizer to the painted surface;

wiping the painted surface with a second chemical free white towel; and drying the painted surface.

20. The method of cleaning a painted surface of claim 19 wherein the painted surface is a silver screen.

* * * * *